United States Patent [19]

Schilo et al.

[11] 4,369,155

[45] Jan. 18, 1983

[54] METHOD FOR THE PRODUCTION OF MELT-SPUN AND MOLECULAR-ORIENTED DRAWN, CRYSTALLINE FILAMENTS

[75] Inventors: Diederich Schilo, Klingenberg; Hans-Dieter Achtsnit, Elsenfeld-Eichelsbach; Gerhard Klug, Elsenfeld, all of Fed. Rep. of Germany

[73] Assignee: Akzona Incorporated, Asheville, N.C.

[21] Appl. No.: 162,029

[22] Filed: Jun. 23, 1980

[30] Foreign Application Priority Data

Jun. 21, 1979 [DE] Fed. Rep. of Germany ..... 2925006

[51] Int. Cl.[3] ..... D02G 1/20

[52] U.S. Cl. ..... 264/103; 264/176 F; 264/210.8

[58] Field of Search ..... 264/168, 103, 176 F, 264/290.6, 210.8

[56] References Cited

U.S. PATENT DOCUMENTS

| | | | |
|---|---|---|---|
| 2,974,391 | 3/1961 | Speckman et al. | 264/168 |
| 3,719,442 | 3/1973 | Schippers et al. | 264/168 |
| 3,798,298 | 3/1974 | Krimper et al. | 264/103 |
| 3,979,496 | 9/1976 | Schwarz | 264/290.6 |
| 4,113,821 | 9/1978 | Russell et al. | 264/176 F |
| 4,217,323 | 8/1980 | Foster et al. | 264/235 |
| 4,251,481 | 2/1981 | Hamlyn | 264/210.8 |

FOREIGN PATENT DOCUMENTS

| | | | |
|---|---|---|---|
| 2117659 | 4/1971 | Fed. Rep. of Germany | 264/176 Z |
| 42-2615 | 2/1967 | Japan | 264/168 |
| 45-35808 | 11/1970 | Japan | 264/210.8 |
| 45-36336 | 11/1970 | Japan | 264/210.8 |
| 46-412 | 1/1971 | Japan | 264/210.8 |
| 48-28012 | 8/1973 | Japan | 264/210.8 |
| 50-58317 | 5/1975 | Japan | 264/210.8 |
| 52-5319 | 1/1977 | Japan | 264/176 Z |

*Primary Examiner*—Jay H. Woo

*Attorney, Agent, or Firm*—Francis W. Young; Tom R. Vestal

[57] ABSTRACT

Production of drawn dilaments by cooling freshly spun filaments at a temperature below the setting point and taking them off at 3500 m/min while passing them over heated surfaces, such heated surfaces being 20 to 300 mm long heated to from 450° to 650° C. and arranged at a distance of from 1500 to 6500 mm from the spinneret.

14 Claims, 3 Drawing Figures

METHOD FOR THE PRODUCTION OF MELT-SPUN AND MOLECULAR-ORIENTED DRAWN, CRYSTALLINE FILAMENTS

The invention relates to a method for the production of melt-spun and molecular-oriented drawn, crystalline filaments of synthetic polymers, whereby after cooling to their setting point the freshly spun filaments are taken up at a rate in excess of 3500 m/min, preferably 4100 to 6000 m/min, over heated surfaces and in the heated zone are heated to temperatures above the setting point, preferably above 150° C., and drawn.

A method of this type is described in German patent disclosure No. 2 117 659. Here the heated surfaces are hot plates whose length is selected so that a thread temperature adequate for orientation and crystallization is attained. In Example 5 of German patent disclosure No. 2 117 659, the length of the hot plate is 1000 mm, the plate temperature 160° C. The filaments emerging from the spinneret are cooled to the setting point before the hot plate and are subsequently heated on the hot plate to temperature above the setting point in the presence of the yarn tensile forces generated by the friction of the surrounding gaseous medium which tensile forces should be equal to the drawing tension required under the given conditions. The influence of heat and tension generates a stretch in the filaments which is related to the increase in molecular orientation and crystallization. At draw-off rates up to 4000 m/min and yarn temperatures up to 220° C., the known process led in polyethylene terephthalate filaments to draw ratios up to 2:1.

The known process has a number of drawbacks. Because of the relatively great length of the hot plate and due to the fact that friction-reducing finishes are applied to the filaments only after the hot plate, the filaments are subjected to severe mechanical stressing which is further aggravated by deposits and thermal degradation of fiber deposits on the hot plate, the result being a poor yarn quality and frequent breakage. Increasing the draw-off speeds above 3500 m/min already creates problems and above about 4000 m/min the frequency of spinning malfunctions is so high as to make industrial-scale production impossible.

The purpose of the invention is to provide a method of the above-mentioned type which even at draw-off speeds as high as 6000 m/min or more will permit unobjectionable operation. Moreover, simplification of the equipment will result in lower investment and energy costs and especially reduce the heat exposure of operators at their workplace.

With the above-mentioned method, this purpose is met in that the heated surfaces: have a length of 20 to 300 mm, preferably less than 200 mm; are heated to a temperature of 450° to 650° C., preferably 500° to 600° C.; and are located at a distance of 1500 to 6500 mm from the spinnerets.

Owing to the drastic reduction in the length of the heated surfaces of heretofore 1000 mm or—at draw-off speeds in excess of 3500 m/min—more, the friction-related mechanical stressing of the filaments traveling on these surfaces is reduced to an acceptable minimum. Preferably, use is made in an otherwise known manner of a hot plate as heated surface. The critical length of 20 to 30 mm, and preferably less than 200 mm, thereby represents the length of contact of the filaments with the hot plate. However, instead of a single hot plate, use may be made of two or more heated contact surfaces, for example, hot plates, hot pins, etc., which, however, should be limited so that the total contact length remains within the above critical limits. By special treatment, the heated surfaces can be made to present even gentler conditions to the filament. Preferably, use is made of electro-chemically chrome-plated, plasma-coated or nickel-diamond treated surfaces. Hot plates e.g. ceramic material may also be used. The roughness index $R_t$ is preferably between 4 and 15 $\mu$m.

The drastic increase in the heating surface temperature from heretofore 220° C. to 450°–660° C., meaning that the heating units may easily be red hot, not only offsets the shorter contact length filament-heating surface, i.e. in spite of the very much shorter contact time the filaments receive sufficient heat to reach the temperature required for drawing, but surprisingly fiber residues deposited on the heated surfaces are burned off so that said heated surfaces are always clean and friction forces created by otherwise known contaminations no longer lead to spinning malfunctions. The specified temperature ranges are critical: a further increase in temperature raises the possibility of thermal degradation of the filaments, whereas lower temperatures would not burn off unavoidable contaminations while again increasing the risk of mechanical degradation of the filaments on the heated surfaces, since the self-cleaning effect essential to the invention is no longer insured.

The distance between spinneret and heated surface is the third main factor of influence. This distance should be between 1500 and 6500 mm, preferably between 4000 and 6000 mm. In particular because of the air friction in the chimney, this distance has a substantial influence on the yarn tension buildup before the heated surfaces. On the heated surfaces the yarn tension is essentially affected by the length of the heated surfaces as well as by the friction coefficient filament vs. heated surface.

Under the above conditions, the filaments are drawn in the zone of the heated surfaces to a ratio of at least 2:1. The term "drawing" relates to conventional stretching involving molecular orientation and crystallization. As a rule, it does not take place at a specific point but rather in a drawing zone located in the area of the heated surfaces. Drawing imparts a higher tenacity to the filaments, whereas elongation and shrinkage are reduced. Typical textile data for polyethylene terephthalate yarn are 35–50 cN/tex for the breaking strength, breaking elongation about 18–35%, hot air shrinkage (190° C.) 6–10% and boiling shrinkage about 3–10%.

The process of the invention applies not only to polyesters but also to other conventional synthetic polymers that can be melt-spun to filaments, such as for example polyamides or polyolefins. The polymers may be modified by the addition of e.g. titanium dioxide, carbon, antistats, etc. The filaments are taken up either combined to threads or conventionally processed to staple fiber. The method is especially suitable for the production of flat yarn; but as explained below, spun-textured or other non-flat yarn can be obtained.

It has already been pointed out that the distance of the heated surfaces from the spinneret should be sufficient to allow cooling of the freshly spun filaments to below their setting point; the filaments have reached the setting point when their diameter no longer changes. The setting points of different polymers are always determined by the high cooling rate of individual filaments below the spinnerets. These correlations can be derived from the literature (for example, from the above-mentioned German patent disclosure No. 2 117 659).

Within the framework of the invention, the draw-off rate relates to the velocity at which the filaments emerge from the above-mentioned drawing zone. It may but need not be identical to the take-up speed.

To obtain filament yarns of very high uniformity, said filaments are preferably held in pressure contact with the heated surfaces by thread guides located after the heated surfaces. The conditions of this mechanical pressure contact should be gentle, for instance using easily rotating pressure rolls, located shortly after the heated surfaces. The filaments traveling on the heated surfaces should preferably be deflected at an angle of $\alpha$ of 2.5° to 10°, especially between 3° and 5°. The angle $\alpha$ is the acute angle of intersection between the extension of the filaments arriving from the spinnerets to the heated surfaces 2A and the extension of the filaments leaving the heated surfaces in the direction of the first thread guide (roll, finish godet, etc.) 2B.

It is possible to apply a finish having a boiling point within the required drawing temperature range to the filaments after setting, but before they reach the heated surfaces; this will prevent thermal degradation of the filaments on the heated surfaces, but workplace conditions will be substantially impaired by the continuously evaporating finish. It is therefore preferable to apply finish to the filaments only after the latter leave the heated surfaces.

The thread guides providing the pressure contact between the filaments and the heated surfaces may preferably also be used to apply finish to said filaments.

The above variants of the method of the invention result in flat yarns as used in, e.g. weaving or warp knitting for the production of, e.g. sheer curtains. The contact conditions between filaments and heated surfaces are preferably selected so that a bicomponent structure is obtained in the filament cross section by having over the cross section of each filament, e.g. a crystallinity gradient leading to a differential shrinkage at the sides of the filaments to the effect that suitable after-treatment will cause individual filaments to crimp. Said bicomponent structure is obtained, for example, when operating at the upper limit of the above-mentioned deflection angle, e.g. between about 7° to 10°. However, in addition to this type of spin-texturing other texturing processes, for example blade crimping or falsetwist-texturing can be integrated in the spin-drawing process of the invention.

Furthermore, very interesting blend yarns of differential shrinkage filaments can be obtained by the method of the invention. This is possible especially when part of the filaments have less contact with the heated surfaces than the rest of the filaments. In the context of this application, "less contact" may mean that part of the filaments travels over a shorter heated surface than the rest of the filaments, or that the temperature of the heated surfaces on which these filaments travel is lower, or that the contact pressure is less. In the extreme, part of the filaments may travel without contact with the heated surfaces, thus leading to a yarn mixture of spun-drawn and high-speed-spun filaments having distinctly different shrinkage and elongation data.

Details of the invention are described in the drawings in which.

Figure 1:
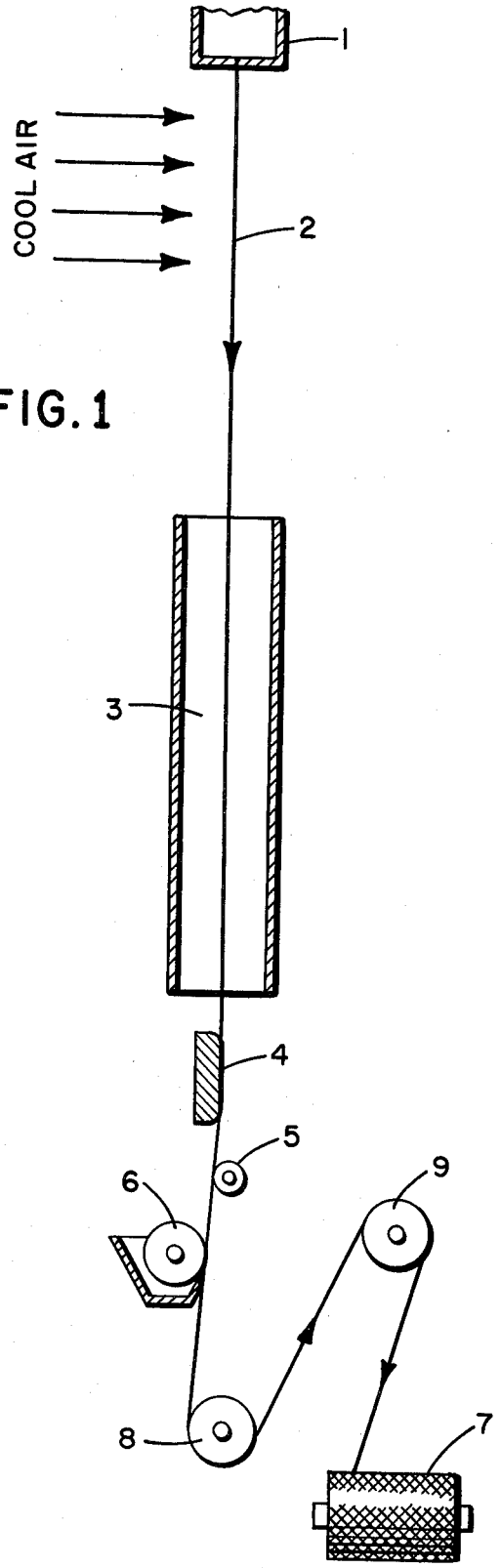
FIG. 1 is a schematic of the process according to the invention.

According to FIG. 1, filaments 2 arriving from spinneret 1 are first cooled to a temperature below the setting point. After emerging from chimney 3 they travel over heated surface 4, being a plasma-coated hot plate of 40 mm length at a temperature of 550° C. Idle roller 5 located below the hot plate regulates the contact pressure of filament 2 on heated surface 4, as well as the deflection angle $\alpha$, shown in FIG. 2. The drawn filaments are treated with a finish on, for example, a finish godet 6, after which they travel to take up unit 7. Deflecting rollers 8 and 9 have been provided to obtain a long traverse triangle for the relatively short machine height and to reduce the yarn tension to a suitable winding tension.

Figure 3:
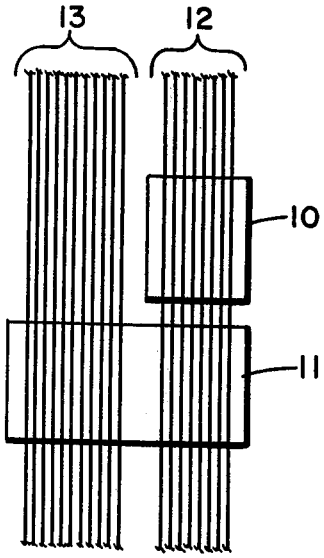
FIG. 3 is a schematic illustration of an embodiment capable of producing filament blend yarns.

FIG. 3 shows a heating device with two heated surfaces 10 and 11 on which filaments 12 and 13, respectively, travel. Filaments 12 travel on both surfaces 10 and 11, whereas filaments 13 are in contact only with bottom surface 11. Filament bundles 12 and 13 which are drawn under different contact situations are subsequently combined, properly blended with a blowing jet and taken up as a filament blend yarn.

EXAMPLE 1

Polyethylene terephthalate chips, delustered with titanium dioxide, are melted and extruded through a 24-orifice spinneret. Melt throughput is 29.5 g/min. The 24 filaments are drawn off at a rate of 4028 m/min over a 75-mm long, plasma-coated hot plate heated to 550° C. The roughness $R_t$ of the plasma coating is 11 $\mu$m. The distance between spinneret and hot plate is about 5000 mm.

Before the hot plate the yarn temperature is 26° C., behind the hot plate 158° C. The yarn denier before the hot plate is 240 dtex, behind the hot plate 78.5 dtex. Yarn tension before the hot plate is 16 g, behind the hot plate 26 g.

Textile data of finished yarn:

| | |
|---|---|
| Denier | 74.6 dtex |
| Breaking strength | 39.5 cN/tex |
| Breaking elongation | 32.9% |
| Boiling shrinkage | 4.4% |
| Hot air shrinkage (190° C.) | 6.1% |

Figure 2:
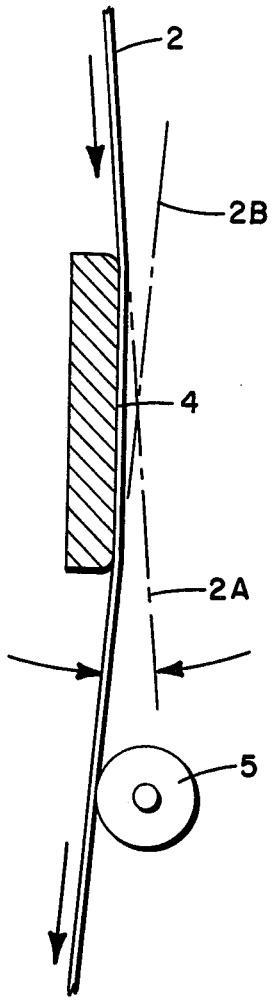
FIG. 2 is an enlarged illustration of the yarn travel in the heated surface zone.

This yarn is produced on a unit as illustrated in FIG. 1.

EXAMPLE 2

The same polymer as in Example 1 is spun at a throughput of 40.6 g/min from a 24-orifice spinneret. Draw-off speed is 5421 m/min. Use is made of a plasma-coated hot plate of 75-mm length and a roughness $R_t$ of 5 $\mu$m at a temperature of 550° C. Said hot plate is located at a distance of 5000 mm from the spinnerets. Yarn temperature before the hot plate is about 30° C., after the hot plate 160° C. Yarn denier before the hot plate is 209.5 dtex, after the hot plate 77.5 dtex. Yarn tension before the hot plate is 28 g, behind the hot plate 38 g.

Here, too, the yarn is spun on a unit as shown in FIG. 1 with a blowing jet located in front of the take-up unit to improve yarn cohesion. Textile data of the yarn:

| | |
|---|---|
| Denier | 81.3 dtex |
| Breaking strength | 42.0 cN/tex |
| Breaking elongation | 21.4% |
| Boiling shrinkage | 6.3% |
| Hot air shrinkage (190° C.) | 10.6% |

EXAMPLE 3

Polycaprolactam chips delustered with 0.4% titanium dioxide are spun from a 24-orifice spinneret. Melt throughput is 29.1 g/min. With the procedure shown in FIG. 1, the filament yarn is taken up at a rate of 3985 m/min via a 75-mm long, electro-chemically chrome-plated hot plate ($R_t$=8 μm). Hot plate temperature=500° C., distance between spinneret and hot plate=5000 mm.

Textile data of the filament yarn:

| | |
|---|---|
| Denier | 58.2 dtex |
| Breaking strength | 40.0 cN/tex |
| Breaking elongation | 41.3% |
| Boiling shrinkage | 10.9% |
| Hot air shrinkage (190° C.) | 6.7% |

We claim:

1. A method for the production of melt-spun and molecularly-oriented, drawn, crystalline filaments of synthetic polymer, comprising cooling freshly spun filaments to their setting point; thereafter contacting said freshly spun filaments in a heating zone with at least one heated surface having a length of 20–300 mm, and being heated to a temperature of 450°–650° C., and being located at a distance of 1500–6500 mm from the spinnerette; drawing said heated filaments in the heated zone; and taking the filaments up at speeds greater than 3500 m/min.

2. The method according to claim 1, wherein the distance between said heated surfaces and said spinneret is 4000 to 6000 mm.

3. The method of claim 1, wherein said heated surfaces have a length of less than 200 mm.

4. The method of claim 1, wherein said heated surfaces are heated to a temperature of from 500° to 600° C.

5. The method of claim 1, wherein said take-up speed is from 4100 to 6000 m/min.

6. The method of claim 1, wherein said filaments are held in pressure contact against said heated surfaces.

7. The method of claim 6, wherein said pressure contact is obtained by means of thread guides located after the heated surfaces.

8. The method of claim 6 wherein said filaments are deflected at an angle, α, of 2.5° to 10° while traveling on said heated surfaces.

9. The method of any of claims 1, 6, 7 and 8, wherein said filaments are wetted with a finish after leaving said heated surfaces.

10. The method of any of claims 7 and 8, wherein said finish is applied to said filaments by said thread guides.

11. The method of claim 8, wherein said angle, α, is from 7° to 10° thereby imparting to said filaments a crystallinity gradient thereby producing a filament cross section having a bicomponent structure.

12. The method of any of claims 8 and 11, wherein part of the filaments have less contact with the heated surfaces than the rest of the filaments thereby producing a blended filament yarn comprising filaments of differential shrinkage.

13. The method of any of claims 1, 8 and 11, wherein said synthetic polymer is selected from the group consisting of polyester, polyamides and polyolefins.

14. The method of claim 9 wherein said finish is applied to said filaments by said thread guides.

* * * * *